US005711468A

United States Patent [19]

Shoemaker

[11] Patent Number: 5,711,468

[45] Date of Patent: Jan. 27, 1998

[54] BATON HOLDER FLANGE

[76] Inventor: Sharon L. Shoemaker, 714 W. Cienega Ave., San Dimas, Calif. 91773

[21] Appl. No.: 562,420

[22] Filed: Nov. 24, 1995

[51] Int. Cl.[6] ..... A45F 5/00

[52] U.S. Cl. ..... 224/251; 224/240; 224/677; 224/675; 224/914

[58] Field of Search ..... 224/914, 251, 224/677, 676, 249, 240, 675, 236

[56] References Cited

U.S. PATENT DOCUMENTS 5,263,619 11/1993 Shoemaker ..... 224/240

5,449,104 9/1995 Parsons et al. ..... 224/677

*Primary Examiner*—Linda J. Sholl

*Attorney, Agent, or Firm*—Boniard I. Brown

[57] ABSTRACT

A holder for a telescoping police baton has a generally tubular body for receiving the baton endwise, either end first. An annular shoulder within the lower end of the body is engageable with the lower end of the baton and has an inwardly extending flange to support the baton vertically and prevent an inner telescoping section of the baton from extending downwardly from the baton holder.

8 Claims, 2 Drawing Sheets

BATON HOLDER FLANGE

BACKGROUND OF THE INVENTION

The present invention relates generally to law-enforcement or police equipment, and more particularly to holders for telescoping police batons.

In the prior art, it has long been the practice for law-enforcement officers to carry batons for use as weapons, crowd-control aids, etc. A baton is generally carried in a baton holder attached to an officer's belt in such manner as to permit rapid removal of the baton when needed. A police baton in current use is a telescoping baton with inner and outer telescoping sections. The inner section is retractable into the outer section to provide a shortened overall length for convenience of carrying. The inner section is rapidly extendable to provide a relatively long overall length of baton, such extension being accomplished by grasping the outer section and rotating the baton with a rapid twist or snap of the wrist to effect extension and retention in extended configuration means of well-known, simplified features of the baton.

Holders for such telescoping police batons generally comprise a holster-like body formed of leather or other appropriate material, and arranged to receive a baton in either extended or contracted configuration, with a strap to retain a baton in the holder body. The holder body has an open upper end through which the baton is insertable endwise, and a closed lower end which supports the baton in the holder body. The bottom portion of the holder body is generally formed of the same material as the holder body, and has a slit-like opening through which the inner section of the baton may extend below the body when the baton is inserted into the holder in its extended configuration.

U.S. Pat. No. 5,263,619 to Shoemaker discloses a relatively hard, wear and stretch resistant shoulder disposed within the lower end portion of a holder body to provide support for a baton in the holder body, either in contracted or extended configuration.

In the course of the service life of a baton holder, the above-mentioned slit-like opening in the lower portion of the holder body tends to become enlarged because of wear, stretching, and tearing, and can become sufficiently enlarged to permit the baton to pass. Impacts and other forces exerted on the baton and on the cover, with its lower portion extended, impose additional strain, wear and tear, all of which can damage the bottom portion and the retaining shoulder. The hard shoulder or ring can become displaced, and can be damaged and suffer breakage, which can result in the baton dropping out through the bottom of the holder.

It can be dangerous for a law-enforcement officer, particularly when in a difficult or confrontation situation, to have his baton become disengaged, drop out or dangle downwardly farther than the extended length of the inner section of the baton. Such situations involve the hazards of an officer being deprived of the use of the baton or tripping over the extended baton.

There has therefore existed a need for an improved baton holder capable of resisting stretching, wear and tear from impacts and other forces, and of providing increased service life.

There exists a need for a baton holder with means for preventing an inner section of a baton from dangling downwardly from the baton holder, thus to prevent the hazards to an officer of such dangling baton by tripping, other accident, or from being deprived of the use of the baton.

SUMMARY OF THE INVENTION

The present invention provides baton holder improvements which address the above-noted deficiencies of the prior art.

Like the baton holder of the above-referenced prior patent, the present baton holder has a generally tubular body having normally upper and lower ends, a cover mounted on the upper end of the body between open and closed positions, and means for attaching the holder to a law-enforcement officer's belt. With the cover member open, a telescoping baton is insertable endwise and removable from the cover body.

The present invention provides a shoulder ring in the lower portion of a baton holder, having a radially inwardly extending flange which provides improved rigidity and service life, with improved structural strength to resist impact breakage, radial forces, and wear and tear.

The radially inwardly extending flange of the shoulder ring according to the invention, prevents the inner telescoping section of the baton from dropping through the bottom of the holder and dangling downwardly. Positive baton retention is provided, and the entire baton, including the inner section, is positively supported against dropping through the bottom of the holder.

DESCRIPTION OF THE PREFERRED EMBODIMENT

Figure 3:
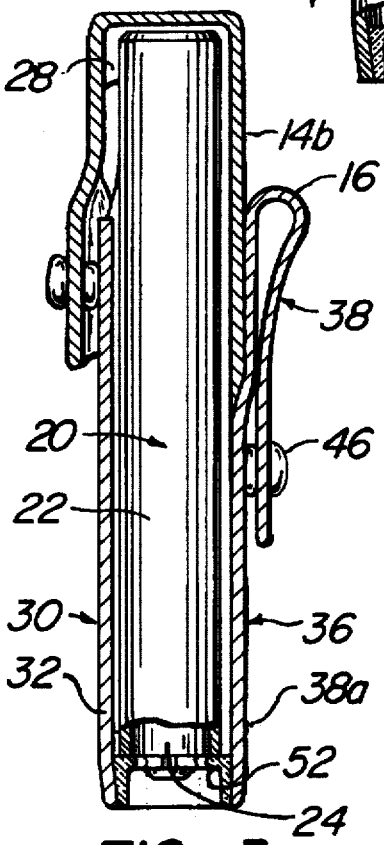
FIG. 3 is a longitudinal section through the baton holder with a telescoping police baton positioned in the holder.
Figure 4:
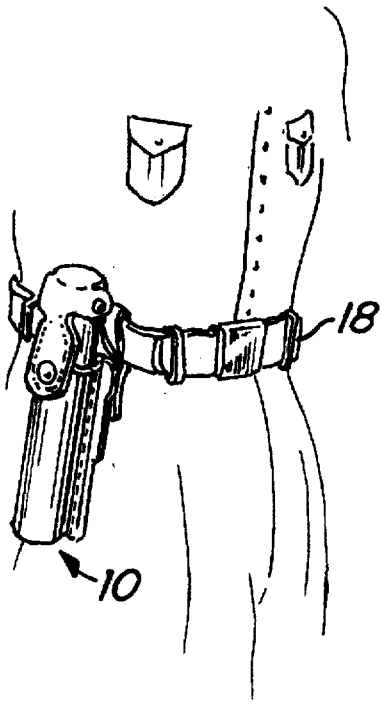
FIG. 4 illustrates the baton holder on the belt of a police officer with the cover of the holder closed to retain a baton.
Figure 5:
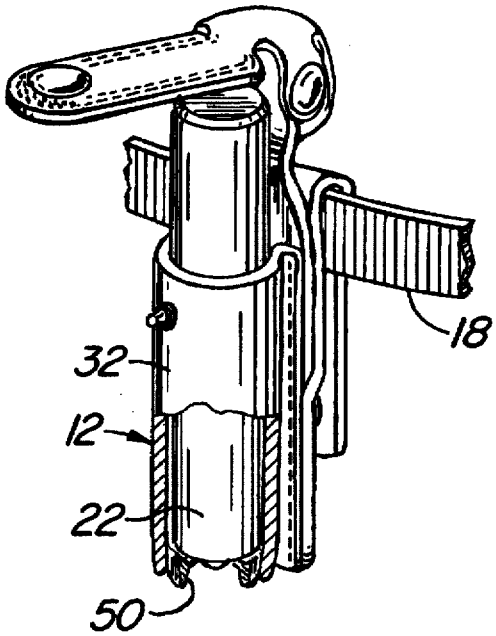
FIG. 5 is a perspective view, partially in section, of the holder of FIGS. 3 and 4, showing a flanged shoulder ring of the invention retaining a baton.
Figure 6:
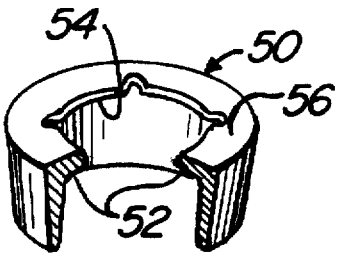
FIG. 6 is a perspective view, partially in section, of a preferred form of flanged ring according to the present invention.
Figure 7:
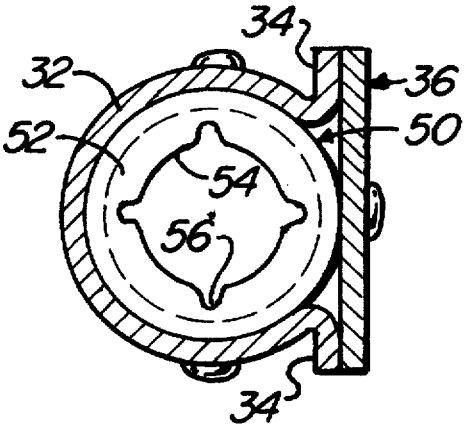
FIG. 7 is a sectional view taken at line 7—7 in FIG. 2.

Referring to the drawings, a baton holder 10 of the invention comprises a generally tubular body 12 having open ends, a cover member 14, and means 16 for attaching the holder to a police officer's belt 18. When the cover member 14 is closed, a central portion 14*a* of the member overlies the open upper end of the holder body The baton holder 10 is adapted to receive a conventional telescoping police baton 20 comprising outer and inner telescoping sections 22, 24. The inner baton section 24 is retracted into the outer baton section 22 to place the baton in its contracted configuration (FIG. 3). The baton includes means comprising mechanical features well-known in the art (not shown) for releasably retaining the baton sections in retracted and extended positions. This releasable retention of the baton inner and outer sections enables an officer to grasp the outer section and, by rapid twist of the wrist, snap the baton to telescopically extend the two sections. The two sections are contracted by being urged together.

Baton 20 is placed in the holder 10 by opening cover member 14 and inserting the baton endwise into the holder body 12 via its open upper end, either end of the baton being insertable end first.

The improved baton holder of the invention, comprises the shoulder 50 in the lower portion of holder body 12 to support the baton vertically within the body, which eliminates the possibility of the baton dropping through the bottom of the holder body, despite substantial wear and damage to which the lower portion of the baton holder may be subjected in service.

Figure 1:
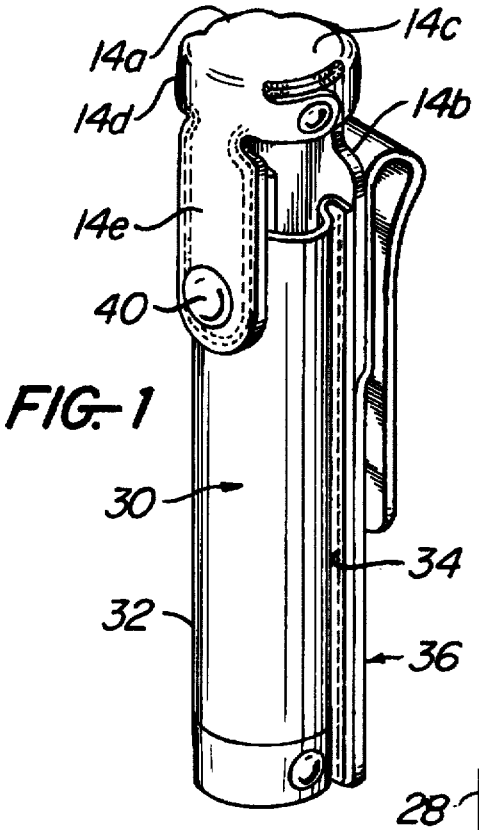
FIG. 1 is a perspective view of a preferred baton holder according to the invention.
Figure 2:
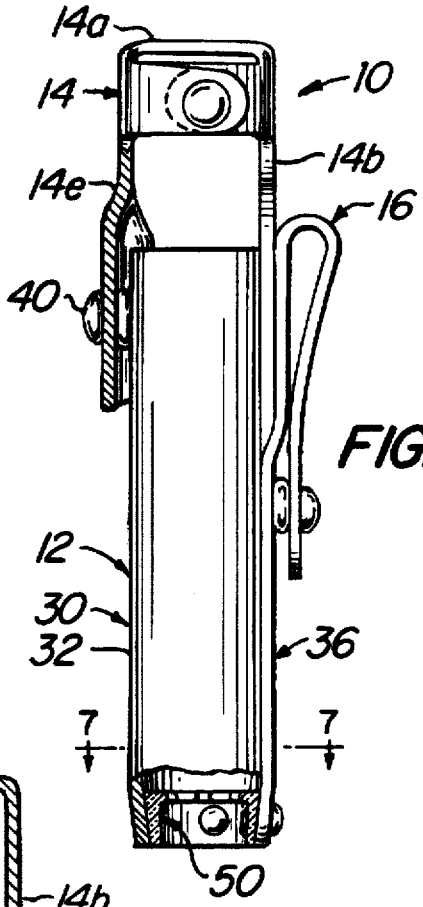
FIG. 2 is a side elevation of the baton holder with portions broken away for clarity, showing a flanged shoulder ring according to the invention.

The body 12 of baton holder 10 comprises a front or outer side wall 30 including a cylindrically curved portion 32 forming a rear or inner opening bounded along two opposite sides by outwardly directed coplanar flanges 34. The holder body has a rear or inner side wall 36 which closes the rear opening formed by the front side wall 30 and comprises in part one end 38*a* of cover member 14. End 14*b* of the cover member seats against the normally upper end portions of the front wall flanges 34. The strap end 38*a* seats against the normally lower end portions of the flanges 34, and overlaps a substantial portion of the end 14*b* (FIGS. 2 and 3). The front wall flanges 34 and the ends 14*b*, 38*a* of the cover member 14 and strap 38 are firmly and permanently joined in any suitable manner as by stitching, rivets, or adhesive. The holder body 12 is generally tubular and comprises the front wall 30 and the rear wall 38 formed, in part, by the end 14*b* of the cover member 14 and in part by the end 38*a* of strap 38.

The central portion 14*a* of the cover member 14 is generally cup-shaped having a normally top wall 14*c* and a generally annular side wall 14*d* about the edge of top wall, which together form the baton receiving cavity 28. Extending from the normally bottom edge of the cover side wall 14*d* at diametrically opposite sides of this side wall are the tongue-like end 14*b* and a second tongue-like flap 14*e*. The end 14*b*, which as noted is secured to the rear side of the holder body front side wall 30, forms a flexible hinge that supports the cover member 14 on the holder body 12 for movement in its said open and closed positions. As shown in FIGS. 2 and 3, when the cover member 14 is closed, its central cup-shaped portion 14*a* overlies, and its cavity 28 opens downwardly toward, the open upper end of holder body 12. The cover flap 14*e* then overlaps the upper front edge of the holder body 12 diametrically opposite attachment of rear cover hinge end 14*b* to the holder body. The holder body 12 and cover flap 14*e* have quick release securing means 40, such as a snap fastener, for releasably securing the cover member in closed position.

Rear strap 38 of holder body 12 forms means 18 for attaching the baton holder 10 to the police officer's belt The free end 38*b* of the strap is secured to the fixed strap end 38*a* by releasably engageable fastening means 48, such as a snap fastener.

A telescoping baton 20 is placed in the baton holder 10 by opening the cover member 14 and inserting the baton endwise, either end first, into the holder body 12 through its open upper end into a housed position within the body wherein the lower end of outer baton section 22 rests on the lower shoulder ring The cover member 14 is then closed. The holder is so sized that when the baton is thus positioned in the holder, the upper end of the baton projects above the upper end of the holder body and into the recess or cavity 28 in the cover member. This engagement of the upper baton end in the cover cavity prevents a person, such as an arrestee, from forcing the cover member sideways to a position which would permit the person to remove the baton from the holder.

FIGS. 2 to 5 illustrate an inwardly extending flange 52 of the shoulder ring 50, according to the invention, which provides improved structural strength and rigidity to resist wear, cracking and breakage during the service life of the holder body from impacts, stress, etc.

Conventional baton holders involve the problem of an officer, in emergency or hurried situations, being likely to shove the extended baton into the holder and let it dangle, with the inner section of the baton extending downwardly. This can involve the hazard of tripping over the extended baton, catching it on objects, etc., with attendant hazards to the officer.

The radially inwardly extending flange 52 of shoulder ring 50 retains the inner baton section 20, 24 in a retracted position within outer baton section 22, and thus prevents the inner baton from dangling downwardly from the baton holder and preventing the above-mentioned hazards.

However, the inner baton section 24 is urgeable through the opening 54 defined by the inwardly extending flange 52 of the shoulder ring upon exertion of substantial force downwardly on the baton with the inner baton section 24 extended. The notches or indentations 56 defined in the edge of the opening assist in enabling the inner baton section to be forced through the opening upon exertion of sufficient force by enabling the flange 52 to deform and enlarge slightly under sufficient force.

Thus there has been shown and described a novel baton holder flange which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A holder for a telescoping police baton having telescoping sections including an outer section and an inner section extendable beyond one end of said outer section, said holder comprising:

a generally tubular holder body having normally open upper and lower ends, a radially inwardly extending flange disposed within said lower open end of the holder and defining an opening, said holder body being adapted to receive the baton endwise in a housed position within said holder body, wherein said outer baton section seats on said flange while the other end of said outer baton section extends above said open end of the holder body for manual grasping for removing the baton upwardly from the holder, said flange has defined therein a plurality of spaced apart notches, said notches extending a limited distance radially outwardly from said flange opening to define deformable flange edge portions between said notches, said inner baton section being receivable by the flange in a retracted position of the inner section within the outer baton section, whereby said inner baton section is urgable through said opening defined by said flange upon exertion of appreciable force on the baton with its inner baton section extended to effect deformation of said ring flange edge portions between notches.

2. A holder for a police baton according to claim 1, and further including:

a cover member on said body having a portion for movement between a closed position wherein a portion thereof overlies said holder body end, and an open position wherein said cover member uncovers said open body end.

3. A holder for a police baton according to claim 2, wherein:

said cover portion has a generally inverted cup shape defining a cavity for receiving an end of the outer baton section when the baton is in its said housed position in the holder body, whereby the baton prevents lateral displacement of the cover member relative to the holder body sufficiently to remove the baton without releasing said fastening means.

4. A holder for a police baton according to claim 2, wherein:

said cover member is normally disposed on the upper end of the holder body to move between closed and open positions to cover and uncover said body upper end.

5. A holder for a police baton according to claim 4, wherein:

said cover member is mounted on the upper end of the holder body to move between a closed position wherein a certain portion of the cover member encloses the open body end, and an open position wherein said cover member uncovers the open body end for endwise insertion and removal of the baton relative to the holder body, means for releasably securing the cover member in said closed position, said cover member including a flexible tongue portion secured to said holder body at one side of the open end thereof to form a flexible hinge to support the cover member for movement between open and closed position, and a flap which overlaps said open body end when said cover member is closed, and said means for releasably securing said cover member in its closed position comprises quick release fastening means on the holder body and said cover flap.

6. A holder for a police baton according to claim 2, wherein:

said cover member is mounted on the upper end of the holder body to move between a closed position wherein a certain portion of the cover member encloses the open body end, and an open position wherein said cover member uncovers the open body end for endwise insertion and removal of the baton relative to the holder body, means for releasably securing the cover member in said closed position, said cover member including a flexible tongue portion secured to said holder body at one side of the open end thereof to form a flexible hinge to support the cover member for movement between open and closed position, and a flap which overlaps said open body end when said cover member is closed, and said means for releasably securing said cover member in its closed position comprises quick release fastening means on the holder body and said cover flap.

7. A holder for a police baton according to claim 1, wherein:

said holder body has a planar rear wall with longitudinal edges, and a front wall including a curved portion having a concave side facing said rear wall and outwardly directed flanges seating against and secured to said rear wall along said longitudinal edges thereof.

8. A holder for a police baton according to claim 1, and further including:

a shoulder ring disposed within said lower open end of the holder body, said radially inwardly extending flange being disposed on said shoulder.

* * * * *